US006212711B1

(12) United States Patent
Gilmour

(10) Patent No.: US 6,212,711 B1
(45) Date of Patent: Apr. 10, 2001

(54) MAT FOR CLOTHING CHANGE AND CARRY

(76) Inventor: Michael Gilmour, 80 Huntington Beach St., No. 618, Huntington Beach, CA (US) 92648

( * ) Notice: Subject to any disclaimer, the term of this patent is extended or adjusted under 35 U.S.C. 154(b) by 0 days.

(21) Appl. No.: 09/409,361

(22) Filed: Sep. 30, 1999

Related U.S. Application Data

(60) Provisional application No. 60/102,814, filed on Oct. 2, 1998.

(51) Int. Cl.[7] ..... A47G 9/06; A45C 9/00; A45C 13/00

(52) U.S. Cl. ..... 5/420; 190/1; 383/4

(58) Field of Search ..... 5/417–420, 655.9; 383/4; 190/1, 2

(56) References Cited

U.S. PATENT DOCUMENTS 3,143,748 * 8/1964 Manning ..... 5/420
4,843,662 * 7/1989 Handelman ..... 5/420
5,010,610 * 4/1991 Ackley ..... 5/420
5,035,013 * 7/1991 Bloom ..... 190/1
5,203,041 * 4/1993 Alonso ..... 5/420
5,210,891 * 5/1993 Avital et al. ..... 5/420
5,666,679 * 9/1997 Ruddy ..... 5/417
5,720,057 * 2/1998 Duncan ..... 5/420
5,887,301 * 3/1999 Anderson ..... 383/4

* cited by examiner

*Primary Examiner*—Alexander Grosz
(74) *Attorney, Agent, or Firm*—Dennis W. Beech

(57) ABSTRACT

The mat for transport of clothing articles and for use in changing into and out of clothing articles in association with water sport activities has top and bottom surfaces which are water and soil resistant. The mat may include one, two or three layers of resistant material to allow enclosure of clothing articles, wet or dry, when folded and secured. Carry handles are provided for ease of transport. The securing means allows egress of moisture in the case of wet clothing articles.

10 Claims, 2 Drawing Sheets

MAT FOR CLOTHING CHANGE AND CARRY

This application claims the benefit of U.S. Provisional Application No. 60/102,814 filed Oct. 2, 1998.

BACKGROUND OF THE INVENTION

1. Field of the Invention

This invention relates to devices used to prevent soiling of wet swim wear, wet suits and the like when removing such articles as for example on a sandy beach or in a parking lot. The new device provides a durable, simple and open mat structure such that wet articles may be removed, dropped on the mat and then the mat folded for carrying while allowing moisture to drain or evaporate. Obviously such devices may be used to transport articles of clothing to a water sport location and used to stand on while dressing.

2. Description of Related Art

There are currently known various forms of mats with draw strings used to form a carry bag, mats which may be rolled for purposes of carrying or storage and mats which fold for purposes of transport. An example of a foldable mat is disclosed in U.S. Pat. No. 4,671,393. This disclosure is a multilayer structure and has an opening layer to expand the mat size when deployed. The mat is rectangular with a means for attachment, hook and loop, sewn around the entire mat edge. While a water and soil resistant layer is disclosed the mat is not designed for carrying and storing wet objects.

The present invention has top and bottom surfaces formed of water and soil resistant composition and a means for folding and securing the mat for transport. The mat is resilient enough to allow inclusion of swim wear, wet suits and the like when the mat is folded and the means for securing allows fluid draining and/or evaporation to diminish the chances of mildew or other moisture related events. Carry handles are also included.

SUMMARY OF THE INVENTION

One object of the present invention is ease of transport of water sport clothing articles to and from a location and changing into or out of the articles without the soiling thereof by the environment. Another object is securing the mat in a manner which allows moisture to drain or evaporate from wet articles contained therein. In accordance with the description presented herein, other objectives of this invention will become apparent when the description and drawings are reviewed.

DESCRIPTION OF THE PREFERRED EMBODIMENT

Figure 1:
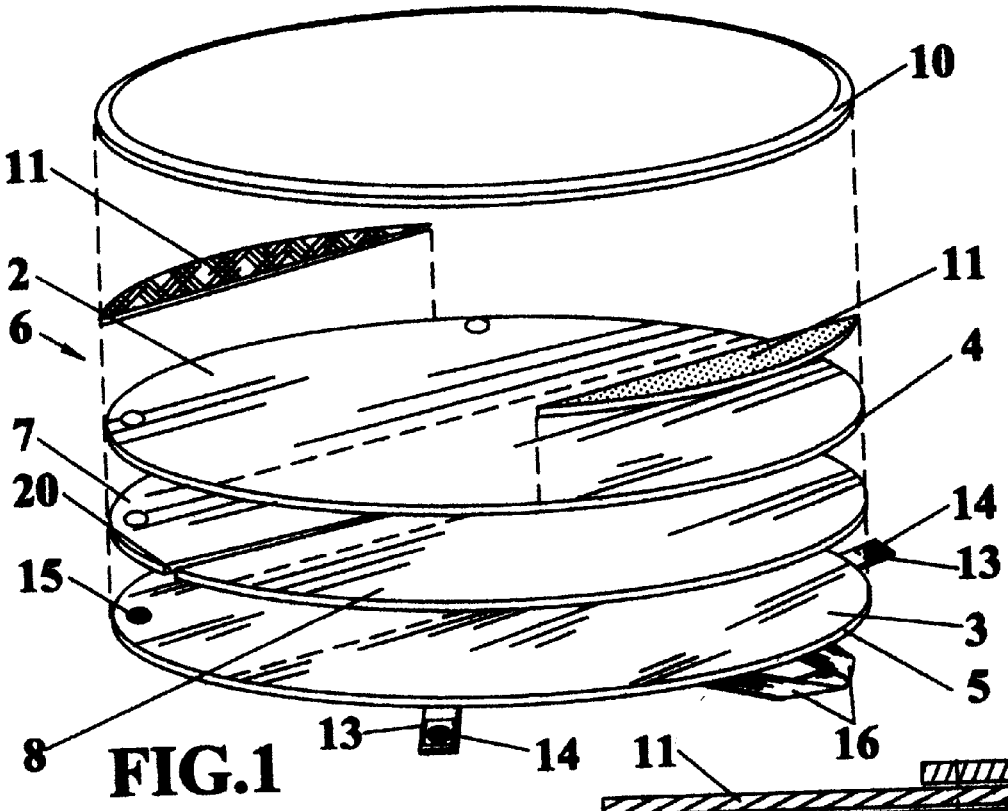
FIG. 1 illustrates an exploded perspective view of the mat elements.

The mat for transport of clothing articles and for use in changing into and out of clothing articles has top and bottom surfaces which are water and soil resistant. The mat may be comprised of one, two or three layers of resistant material to allow enclosure of clothing articles, wet or dry, when folded and secured. Carry handles are provided for ease of transport. The securing means allows egress of moisture in the case of wet clothing articles.

Referring to FIGS. 1 through 5, the mat (1) in the preferred embodiment is illustrated as having three layers of material wherein a top layer (2) and bottom layer (3) are secured around edges (4,5). An intermediate layer (6) of material is enclosed between the layers (2, 3). The intermediate layer (6) is preferably constructed of thin sheet closed cell foam material formed as two halves (7, 8) which provide stiffening for the mat (1) yet are resilient enough to allow clothing articles (9) to be sandwiched within the mat (1) when it is folded and secured. The top layer (2) is preferably comprised of a unique non-slip nylon material and the bottom layer (3) of a vinyl material.

Figure 2:
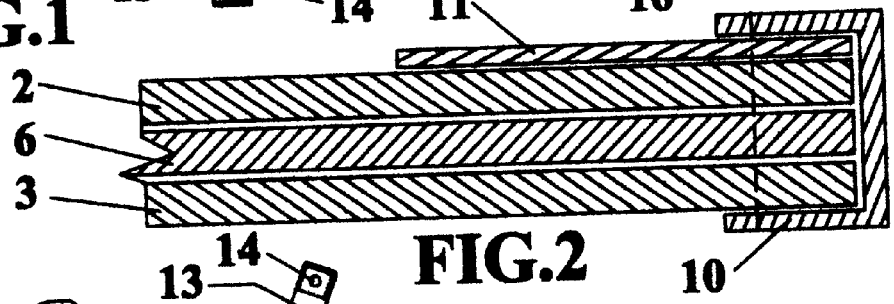
FIG. 2 illustrates a cross-sectional view of the mat taken at line 2—2 in FIG. 3.

The three layers (3, 4, 6) may have a border band (10) of acrylic material folded over edges (4, 5) and sewn together for additional structural support. In FIG. 2, this is also illustrated to fold over the fastening element (11) shown as a hook and loop material and the intermediate layer (6).

A fold element (12) is formed in the mat (1) layers at the separation (20) of the intermediate layer (6) foam halves (7, 8) by means of sewing, heat attachment bonding or other suitable means for the layers (2, 3) material. When open, the mat (1) serves as a platform, as for example on a sandy beach or asphalt parking lot, on which to change clothes to avoid soiling the clothing articles (9). When the water sport activity is complete, as for example surfing using a wet suit, the wet suit can be removed and deposited on the mat (1). The mat (1) may then be folded along fold element (12) and secured with fastening element (11). If additional securing is necessary, straps (13) with attachment elements (14, 15) may be used. In the figures the attachment elements (14, 15) are illustrated as snaps; however, well known means such as hook and loop and the like may be used.

In this folded for transport configuration a portion of the edges (4, 5) are not secured or sealed. This allows egress of moisture or breathing of the device such as to inhibit mildew, mold or the like with regard to the wet clothing articles (9). Carry handles (16) are attached to the mat (1) for ease in carrying the mat (1).

Figure 3:
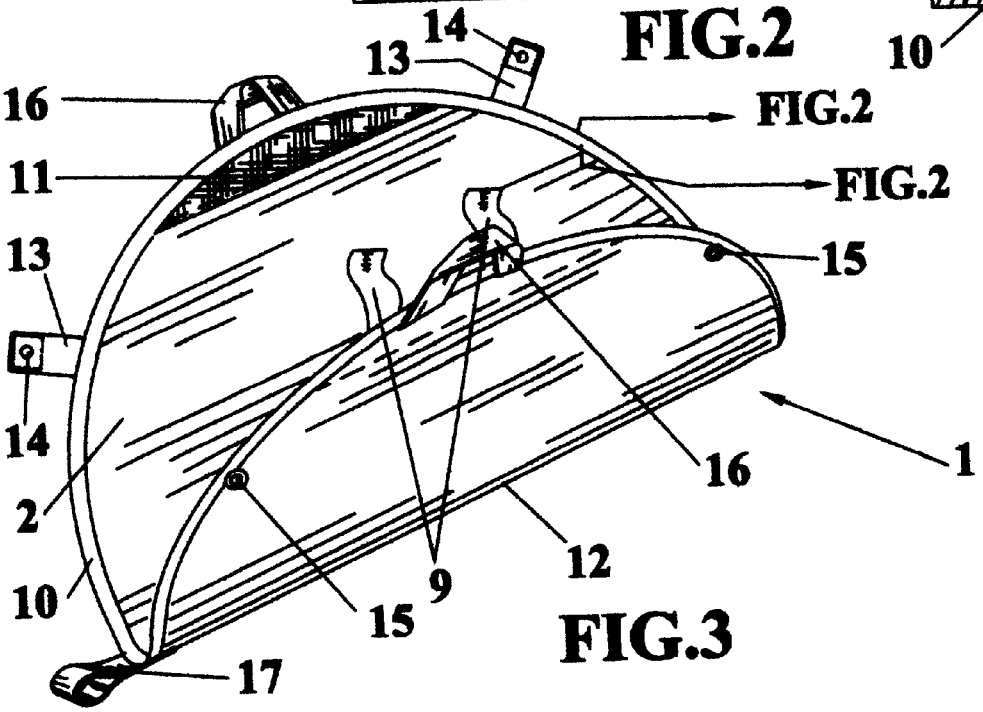
FIG. 3 illustrates a perspective view of the mat partially folded.
Figure 4:
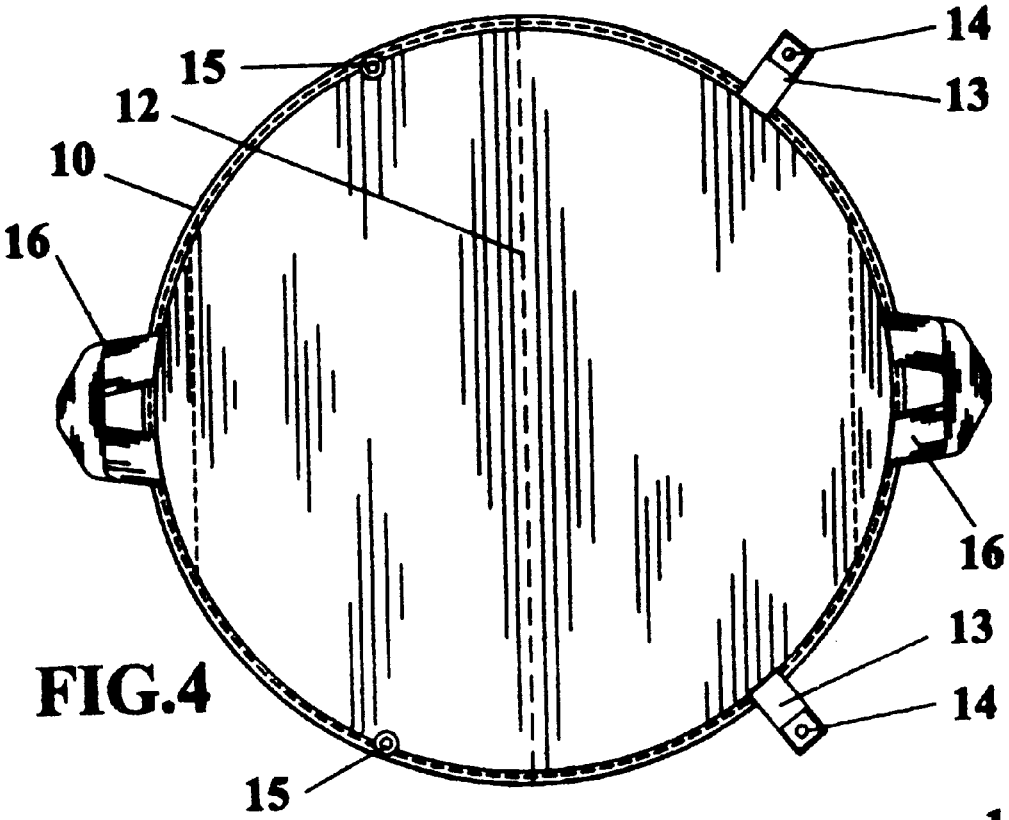
FIG. 4 illustrates a bottom view of the mat.
Figure 5:
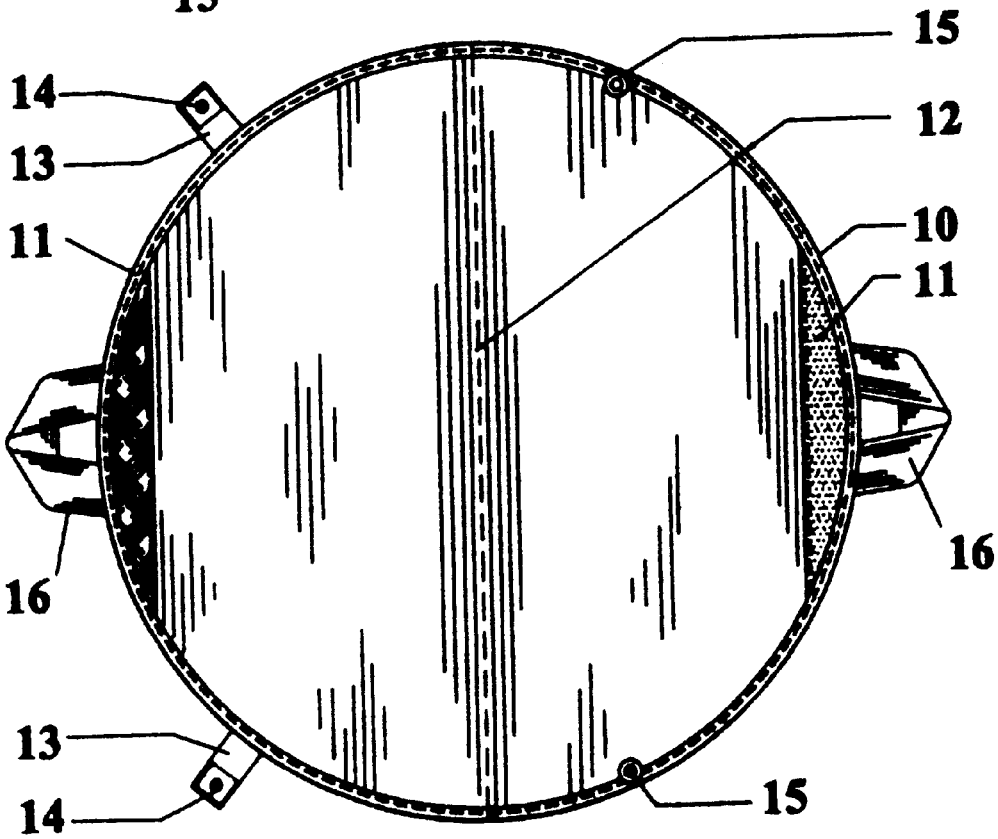
FIG. 5 illustrates a top view of the mat.

While the mat (1) has been described and illustrated as a three layer material device, obviously one or two layers may also be used to construct the device. For example in a one layer mat (1), a single layer of material would be formed of a stiffened, resilient material of any well known composition, such as closed cell foam, polyurethane foam, typical stiffened swim wear wet suit material and the like which is soil and water resistant. The fastening element (11) and straps (13) would then be attached to the surface of the single layer material as would be the carry handles (16). A fold element (12) could be created by a relatively thinner amount of material along the fold line, by joining two halves of the single layer material with a hinge or other suitable means. A loop strap (17) can also be attached to the mat (1) as illustrated in FIG. 3 for use in hanging the mat (1) with or without contents. This allows moisture or water to drain. The loop strap (17) may be fixedly attached as a loop or have one strap end fixedly attached to the mat (1) and the opposite end having a detachable attachment element such as hook and loop such that the loop strap (17) may opened and then for example secured around a hanger.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for carrying and changing clothing comprising:

a mat comprised of a top layer, a bottom layer and an intermediate layer of material attached around the edges thereof by a means for attachment, said mat having a fold element formed therein such that the mat may be folded and secured by a means for fastening at a portion of an edge wherein the top layer is a non-slip nylon material, the intermediate layer is closed cell foam material and the bottom layer is a vinyl material.

2. The device as in claim 1 wherein the means for fastening is hook and loop material attached along a portion of the edge such that when the mat is folded the hook and loop material engages.

3. The device as in claim 2 wherein the mat has a pair of straps with attachment elements for further securing the mat when folded.

4. The device as in claim 1 wherein there are a pair of carry handles attached to facilitate carry of the mat when folded.

5. The device as in claim 1 wherein the intermediate layer is formed of two material halves and the intermediate layer is enclosed between the top layer and the bottom layer.

6. The device as in claim 1 wherein a border band is folded over and around edges of the top layer, the intermediate layer and the bottom layer and attached thereto by the means for attachment.

7. The device as in claim 6 wherein the border band is a vinyl material.

8. The device as in claim 6 wherein the border band is an acrylic material.

9. The device as in claim 1 wherein the top layer and the bottom layer material are marine grade.

10. The device as in claim 1 wherein a loop strap is attached to the mat.

* * * * *